US007174578B1

(12) United States Patent
Mitchell

(10) Patent No.: US 7,174,578 B1
(45) Date of Patent: Feb. 13, 2007

(54) UNIVERSAL TOILET COVERING

(76) Inventor: Angela Mitchell, 1316 Raynor Dr., Virginia Beach, VA (US) 23456

( * ) Notice: Subject to any disclaimer, the term of this patent is extended or adjusted under 35 U.S.C. 154(b) by 0 days.

(21) Appl. No.: 11/363,899

(22) Filed: Feb. 28, 2006

(51) Int. Cl.

| | |
|---|---|
| ***A47K 17/00*** | (2006.01) |
| ***A47K 1/00*** | (2006.01) |
| ***E03C 1/00*** | (2006.01) |
| *A47K 11/04* | (2006.01) |

(52) U.S. Cl. ..... 4/661; 4/254

(58) Field of Classification Search ..... 4/253, 4/254, 465, 478, 661

See application file for complete search history.

(56) References Cited

U.S. PATENT DOCUMENTS

| | | | | |
|---|---|---|---|---|
| 804,019 | A | 11/1905 | Lotz | |
| 1,527,340 | A | 2/1925 | Wood | |
| 2,749,968 | A | 6/1956 | Susar | |
| 6,311,341 | B1 * | 11/2001 | Zwezdaryk | 4/254 |
| D454,185 | S | 3/2002 | Lantigua et al. | |

* cited by examiner

*Primary Examiner*—Tuan Nguyen
(74) *Attorney, Agent, or Firm*—Godizen & Associates; Bradlely D. Goldizen

(57) ABSTRACT

The present invention is a toilet cover that includes a plurality of support members, at least two face panels and at least a pair of hinged covers. Stepped sides are provided for certain applications where walls are not provided on either side of a toilet. A horizontal member having a key-hole shaped to accommodate slide around the toilet bowl and tank may be provided in certain applications. The support members attach to walls behind or on either side of a toilet. The face panels, hinged covers and stepped sides attach to the support members. An upper face panel includes a flushing mechanism or an opening through which a flushing handle extends. Drawers or shelves with doors may be provided for storing toiletries and the like. The toilet cover is formed in the shape of a bench for utilitarian functions.

19 Claims, 7 Drawing Sheets

UNIVERSAL TOILET COVERING

There are no related patent applications.

The subject matter of the present invention did not receive federal government research and development funding.

BACKGROUND OF THE INVENTION

The present invention generally relates to a universal covers for toilets. More particularly, the present invention relates to a toilet cover that comprises several panels attached to support members to encase a toilet and convert an area around the toilet into a more functional region. The cover is provided in kit form with various pieces such that it is easily modified to cover toilets in a variety of bathroom layouts. Thus, various panels or support members may be unused in certain bathroom layouts.

A problem encountered with modern toilets is that they reduce usable space in a bathroom when they are not being used. Another drawback is their unsightliness if not properly maintained or kept clean. Several patents have been directed towards the modification of toilets for useful purposes and/or beautification of a bathroom.

U.S. Pat. No. 2,749,968 to Suser discloses an overall cover for water closets and flush bowls. Suser proposes a cover of sheet-like structural material formed to provide the general characteristics of a bench. One drawback to Suser is that it provides no ability to be modified for different bathrooms having various footprints or layouts. The present invention overcomes the problems associated with Suser.

Most bathrooms have the same standard style of toilet presented in the same standard fashion. Some United States patents have presented different styles and purposes that vary from this common standard. U.S. Pat. No. 6,760,929 introduced a toilet designed for people with temporary or permanent limited mobility. The device was intended for use as an intermediary device placed near the bedside of the use. It also had a wedged angle and guardrail meant to make it easier for said persons to use the toilet. U.S. Pat. No. 6,892,402 disclosed a toilet designed for males. Finally, U.S. Pat. No. 6,889,393 revealed a portable combination of a stool and toilet.

While the prior art has addressed different varieties of toilets intended for different uses, no U.S. patent has addressed improving the standard toilet in its typical environment. To that end, the current invention offers a new and improved design for the standard toilet in its most common environment.

SUMMARY OF THE INVENTION

The current invention is a covering that encloses a toilet to provide a bench and storage area. The covering consists of wood or other solid material that is constructed over and around a new or existing toilet. The cover comprises two hinged closures or lids. The size of the lids may vary from application to application. The upper lid provides access to the top of the toilet tank for maintenance purposes. The lower lid provides access to the toilet bowl for use and cleaning of the toilet and may be wide enough to allow easy access to a toilet water supply valve. Each lid is equipped with a handle for allowing easy access to the toilet. A pair of hinges attaches the upper hinged lid that covers the toilet tank to either a support member that is secured to a wall behind the toilet tank or the wall behind the toilet tank. A second pair of hinges attaches the hinged lid that covers the toilet bowl to an upper face panel that covers the front of the toilet tank.

The toilet covering also comprises a pair of stepped sides that encase the toilet from the sides where necessary. Either one or both of the stepped sides may be unnecessary where a toilet is arranged between walls or close to a wall. In an additional embodiment, the stepped sides may include grooves for accepting both an upper and lower face.

Support members are provided for attaching the upper and lower front face panels to either the stepped sides or a wall. The face panels may comprise drawers or doors that open to provide storage space for toiletries, cleaning or service implements such as brushes and plungers. The upper face panel extends between the two hinged covers. The lower face panel extends from a floor to which the toilet is mounted and the lower hinged cover. In another embodiment, the sides may be equipped with grooved regions for accepting the upper and lower face panels. In this embodiment, the support members connect the sides of the cover together and provide structural support for an upper and a lower face member.

In one embodiment, a horizontal panel extends between the upper and lower face panels and may include a removed area corresponding to an opening in a toilet bowl, as well as an overhead profile of the exterior front and sides of the toilet tank. This removed area that corresponds to the toilet bowl is covered by the lower hinged lid. The sides of the horizontal panel that extend around the toilet tank may operate as bottoms for cabinets provided on either side of the tank and having doors and openings in the upper face panel. A lip of the horizontal panel is preferably caulked or sealed to the toilet bowl and tank. Otherwise, the horizontal panel may not be included in the cover and the lower hinged lid may extend across the toilet bowl and rest upon horizontal support members fastened to either the stepped sides, to walls on opposite sides of the toilet or a combination thereof.

The upper face panel also features an opening to allow the toilet handle that flushes the toilet to extend outward. Alternatively, the upper front panel may comprise a device that connects to a flush handle mounted on the toilet tank to allow the toilet to be flushed. The device may include a handle that includes a collar mounted in the upper face panel for allowing the device to rotate counterclockwise to cause the toilet to flush. A tongue is provided on an opposite of the upper face panel for receiving the flush handle of the toilet. As the device is rotated, the flush handle of the toilet is operated to flush the toilet.

The current development involves an innovative improvement on a design implemented in almost every bathroom. The toilet covering provides such a vast improvement over the prior art because of its enhanced utility, flexibility and aesthetics. The toilet offers increased utility for several reasons. First, the bottom portion covering the toilet seat is wide and easily serves as a bench that can be used for getting dressed, applying lotion, cutting nails, or merely a place to rest for a moment. Such a bench is ideally suited for the elderly who often have special conditions causing them fatigue and weakness. Since a toilet seat is narrow and hazardous, offering a wide bench is obviously a safer alternative. In addition, the upper portion covering the toilet tank can provide additional utility. It can act as a shelf to store toiletries and similar items, or in another embodiment may include a wooden cabinet. This cabinet could similarly hold toiletries or towels and would be built over the design in a manner that still facilitated access to the toilet tank. Other embodiments also offer additional utility. In one such embodiment an inside compartment is built within the top portion to store the plunger and toilet bowl brush in a convenient, and because it is unseen more aesthetically pleasing, location. While the flush handle can be extended through an opening from its typical location, another embodiment offers another option. In this embodiment the flush handle is hooked up to an automatic flush system that is triggered by depressing a button.

The instant toilet covering's design also offers superior flexibility. It can be built into any bathroom, whether the toilet is new or existing. The design follows a certain model, but may be modified to fit any area of any size and shape.

Finally, this invention gives a more aesthetically pleasing alternative to looking at a toilet. Many individuals do not wish to look at a toilet while brushing their teeth or taking a bath. Also, depending upon the wood that is used, the design also may prevent unpleasant odors from being emitted from the toilet after the hinged covers are closed. Some woods, such as pine and cedar exude a pleasant smell that counteracts any undesirable odors. In the alternative, the design could also be tiled or painted over, offering another aesthetic design option.

The above explanations are provided to illustrate the utility of the invention. And, by no means necessary were these explanations intended to limit the application of this invention to other purposes.

BRIEF DESCRIPTION OF THE DRAWINGS

In FIG. 3A, the cover includes a pair of stepped sides. FIG. 3B depicts an embodiment of the invention where a wall is provided on a side of the cover.

FIG. 3C is an embodiment of the invention where walls are arranged on either side of the cover.

In FIG. 4A, the invention includes a pair of doors that open to storage areas on either side of the toilet tank. In FIG. 4B, a second embodiment of the invention is shown with the toilet in broken lines. In FIG. 4C, a third embodiment of the invention is shown with the hinged cover shown opened. FIG. 4D shows an additional embodiment of the invention wherein the horizontal member is removed. In FIG. 4E, a plurality of covers is provided intermediate between the upper and lower faces and cover 13.

DETAILED DESCRIPTION OF THE INVENTION

Figure 1:
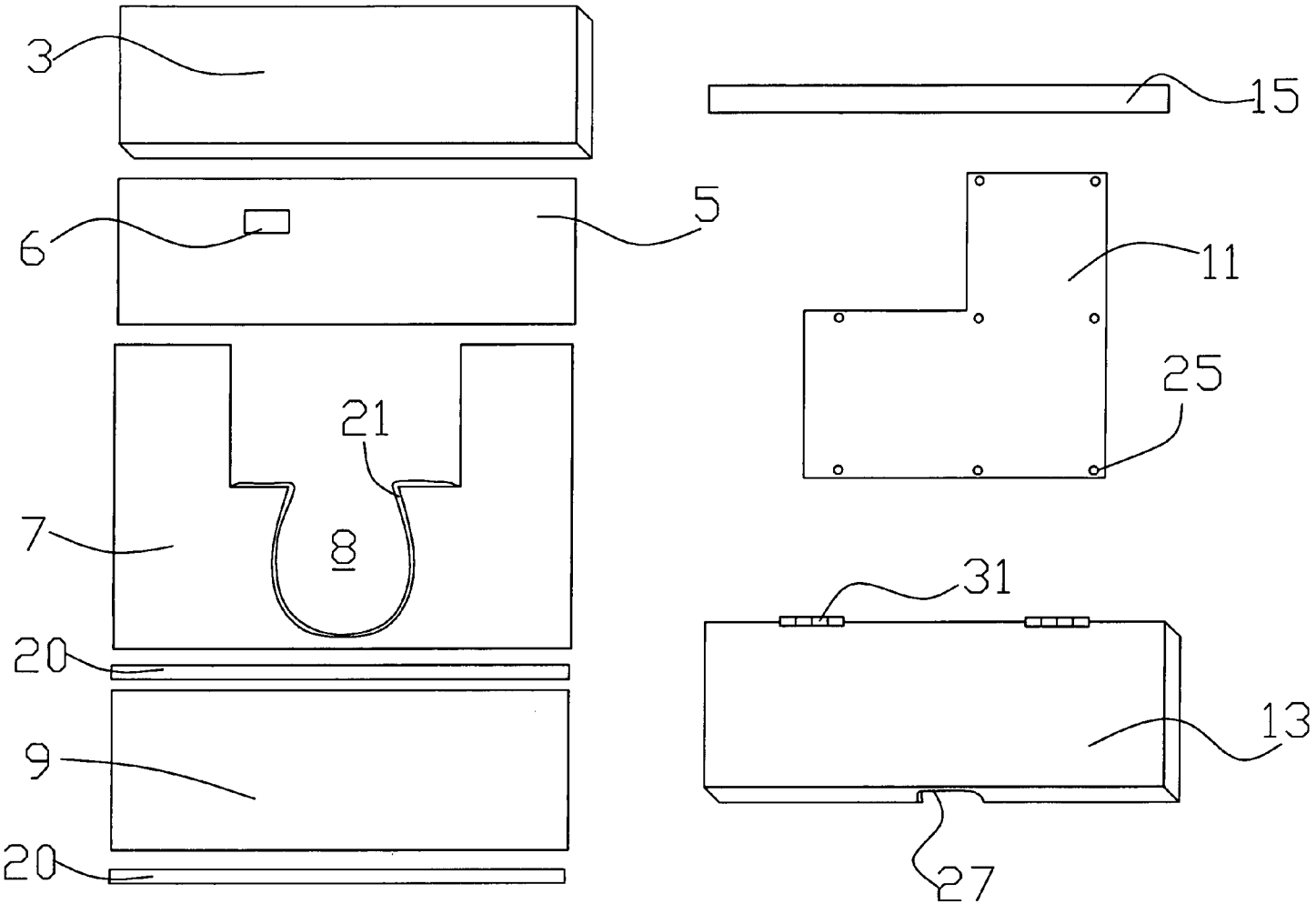
FIG. 1 is a plan view of the various parts of the toilet cover.

FIG. 1 shows the various parts that comprise the cover 1. The toilet cover 1 includes an upper lid 3 that comprises a rigid sheet material. The upper lid 3 comprises a front, a back and a pair of sides, as shown. The rigid sheet material may comprise wood, plastic, composite or the like. Preferably, the material is waterproof to prevent damage in the event of a water leak or exposure to moisture.

An upper face panel 5 comprises a planar material and in one embodiment also features an opening 6 to allow a toilet handle that flushes the toilet to extend outward. The upper face panel 5 includes an upper edge, a lower edge and two sides, as shown. Preferably, the upper face panel 5 is twenty-four inches wide. Molding 20 may be provided at the upper and lower edges. Instead of including an opening 6, the upper face panel 5 may comprise a device that connects to a flush handle mounted on the toilet tank to allow the toilet to be flushed.

In one embodiment, the covering 1 includes a horizontal member or panel 7 that includes a keyhole opening 8 shaped in the form of a toilet bowl and toilet tank. The horizontal member 7 comprises a waterproof, planar material and may include caulking 21 or the like that seals it to the toilet bowl when in use. The horizontal member comprises a front edge, a back edge and two sides, as shown. In another embodiment, the cover 1 does not include the horizontal member 7.

A lower face panel 9 comprises planar sheet of waterproof material and includes an upper edge, a lower edge and two sides. Preferably, the lower face panel 9 is twenty-four inches wide. Decorative molding 20 may be fastened to the edges. Support members 15, shown more clearly in FIGS. 2A and 3A through 3C are preferably formed from one-inch by one-inch wood or the like provide structural support for the covering. The support members may be cut to fit different bathroom layouts. Screws, nails, adhesives or other fasteners 25 are provided for securing the support members 15 to stepped sides 11.

A bench lid 13 is provided with hinges 31 that couples the lid 13 to the upper face 5. Lid 13 comprises a handle 27 for aiding one in gaining access to a toilet. Stepped sides 11 are provided for different applications when walls are absent on either side of the toilet. The stepped sides 11 include a lower edge and an upper edge. The lower edge is preferably thirty inches or more long. The upper edge is preferably 10 to 12 inches long.

Figure 2A:
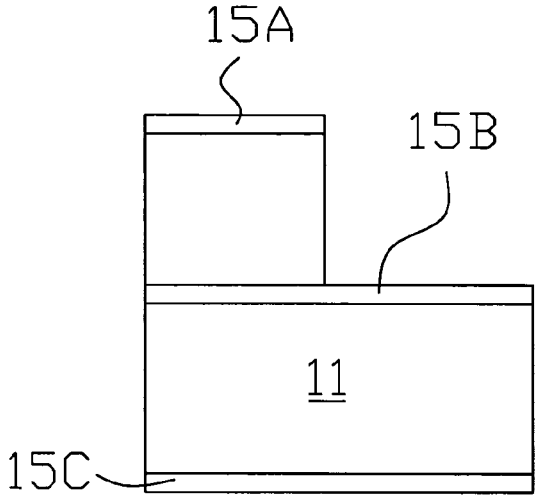
FIGS. 2A and 2B are interior and exterior views of support members attached to a stepped side.
Figure 2B:
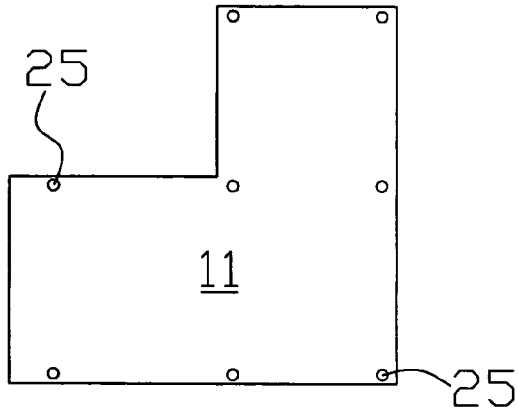

FIGS. 2A and 2B are interior and exterior views of the stepped sides 11. A plurality of support members 15 are secured to an interior side of the stepped side 11 via fasteners 25. Preferably, the fasteners 25 are nails or screws. A short support member 15A is fastened near an upper edge of the stepped side 11 as shown. A second support member 15B is fastened near the middle of the stepped side 11. A third support member 15C is fastened near the lower edge of the stepped side 11. The length of the second and third support members 15B and 15C may be equal as shown.

Figure 3A:
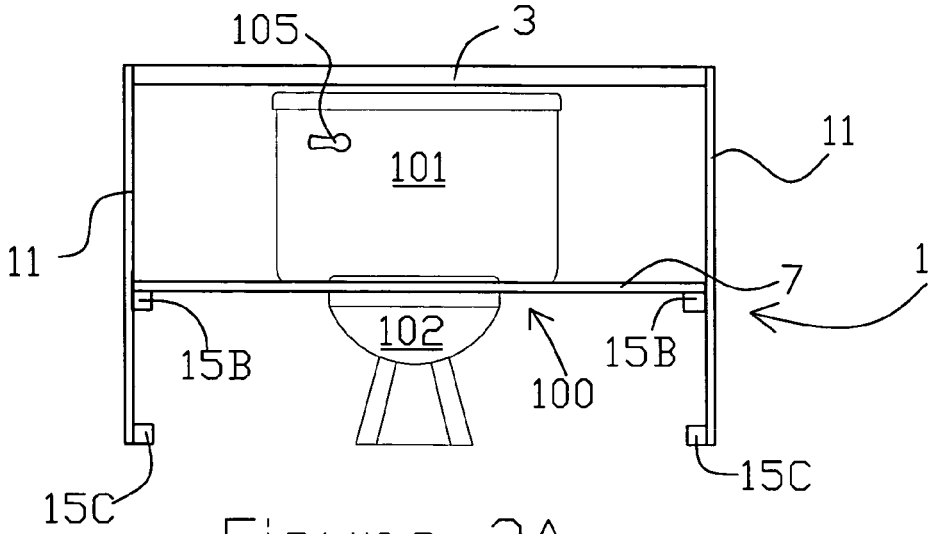
FIGS. 3A through 3C show various embodiments of the invention.

FIG. 3A depicts a cover 1 having the upper and lower face panels 5 and 9 removed. The toilet 100 comprises a toilet tank 101 and a bowl 102. A flushing handle 105 is provided for flushing the toilet 100 to remove waste from the bowl 102. Horizontal panel 7 rests atop a pair of support members 15B, as shown. Fasteners such as screws or nails may be passed through the edges of the horizontal panel 7 to securely fasten the horizontal panel 7 to sides 11 via support members 15B. Additional fasteners may also be passed through support members 15C to add rigidity to the cover 1 and fasten it to the floor upon which the toilet is mounted. FIG. 3A is a first embodiment where two sides 11 comprise the cover 1 and is useful when the toilet is mounted away from a wall on either the left or right side.

Figure 3C:
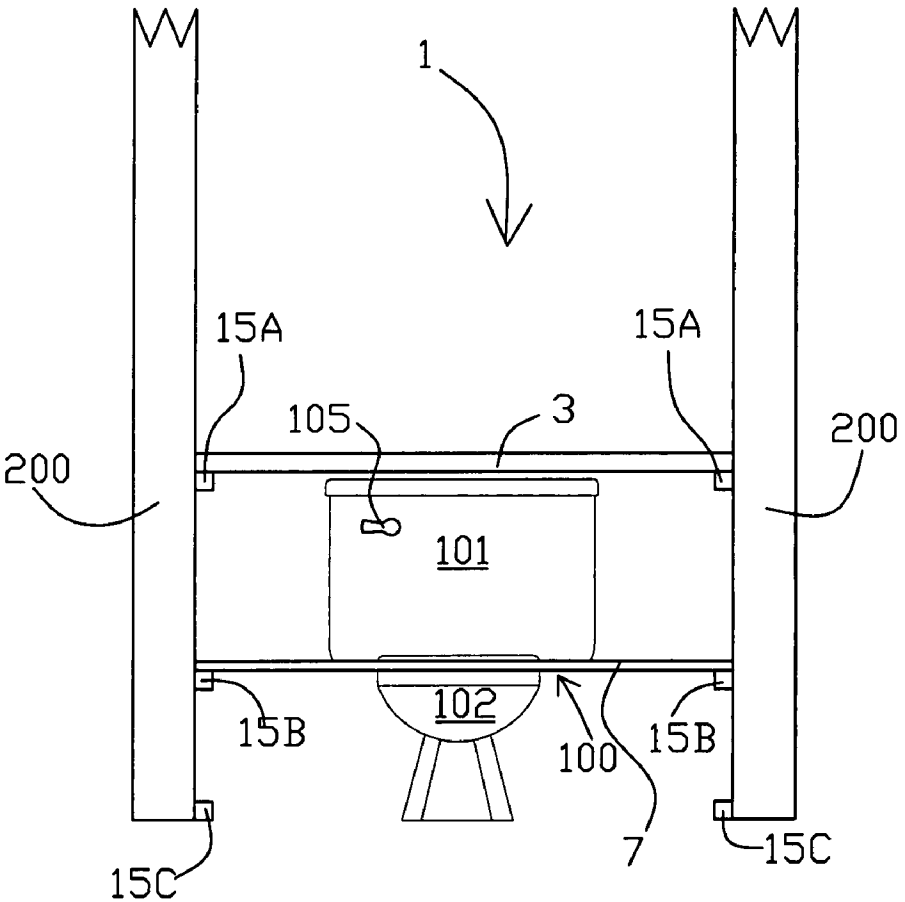
Figure 3B:
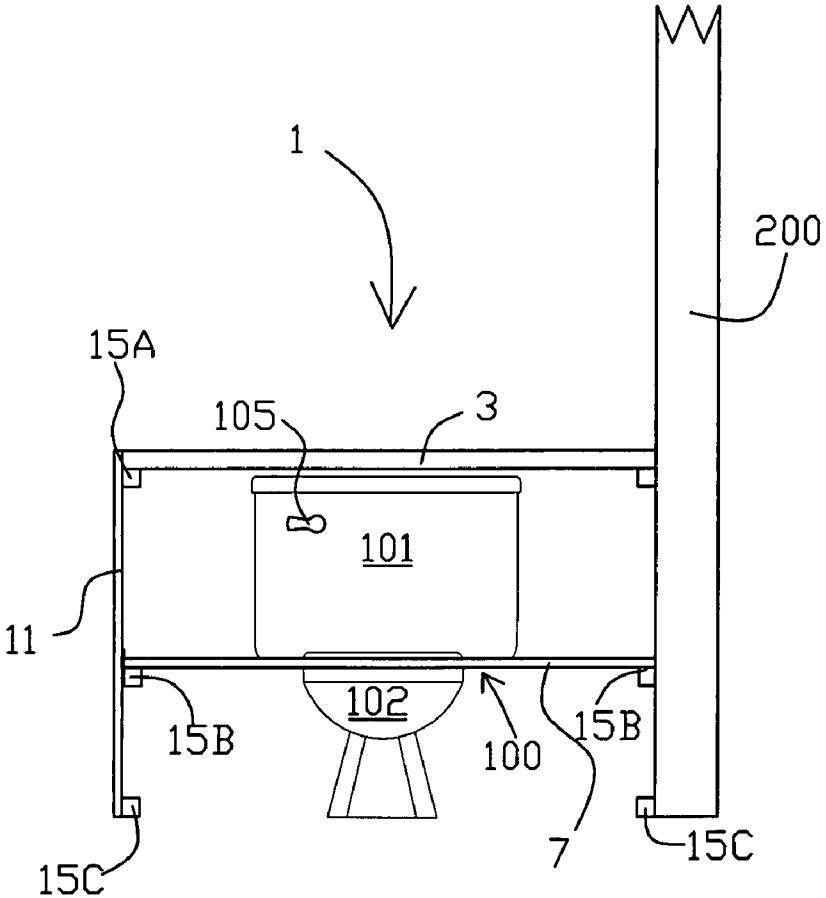

FIGS. 3B and 3C are embodiments of the cover 1 where a wall is either located on either side of the toilet 100 or on both sides thereof. In FIG. 3B, support members 15 are secured to the wall 200 and side 11 via fasteners 25 (not shown). In FIG. 3C, cover 1 is fastened on either side to walls 200 via support members 15 and fasteners 25 (not shown).

Figure 4B:
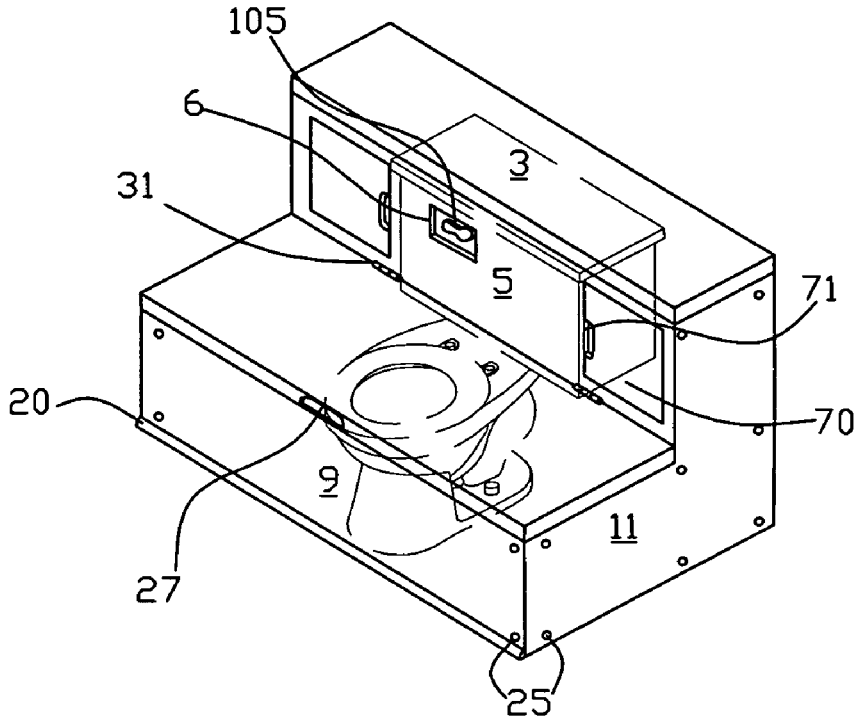
FIGS. 4A through 4E show various embodiments of the invention.
Figure 4A:
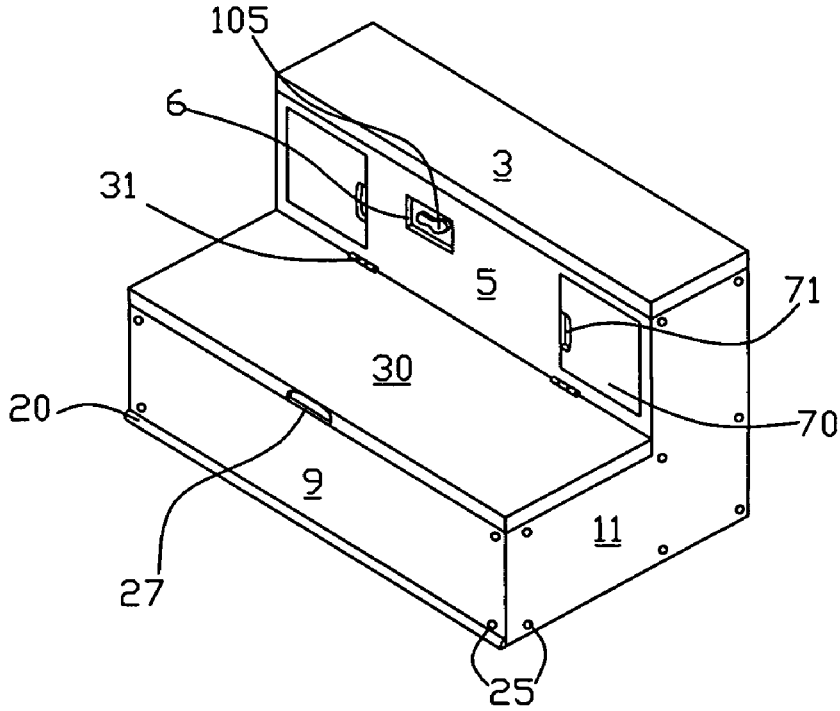
Figure 4C:
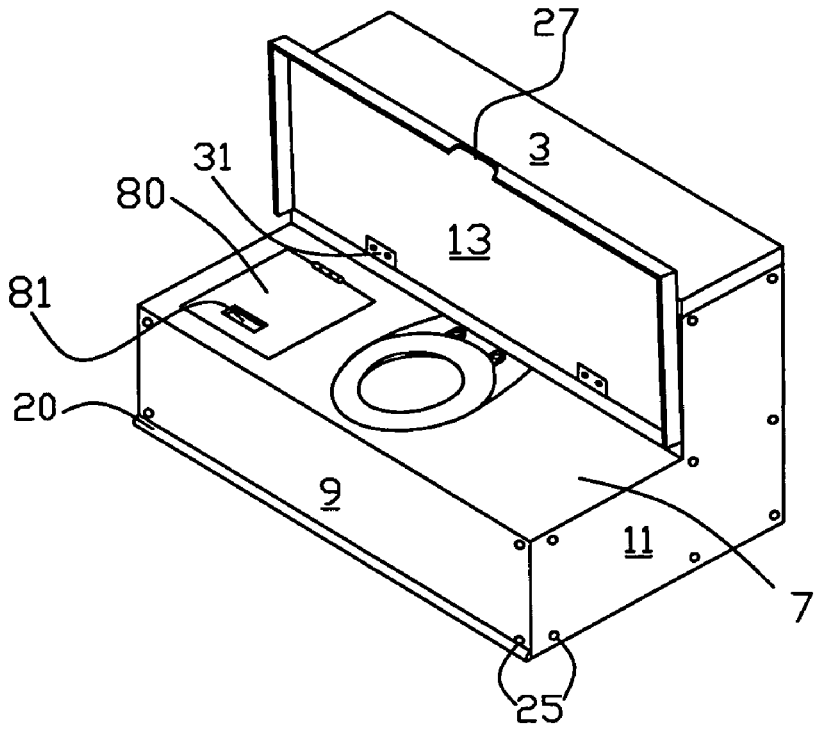

FIGS. 4A through 4E show various embodiments of the invention. In FIG. 4A, the cover 1 includes doors 70 located on either side of the upper face panel 5. Each door 70 includes a handle 71 for ease in opening them. Shelves or the like may be included behind each door 70 for storing toiletries or the like. FIG. 4B shows the toilet 100 shown in phantom and its relation to the cover 1. In FIG. 4C, the horizontal panel 7 includes a door 80 that comprises a handle 81. The door 80 provides access to storage area as well as access to the water supply valve.

Figure 4D:
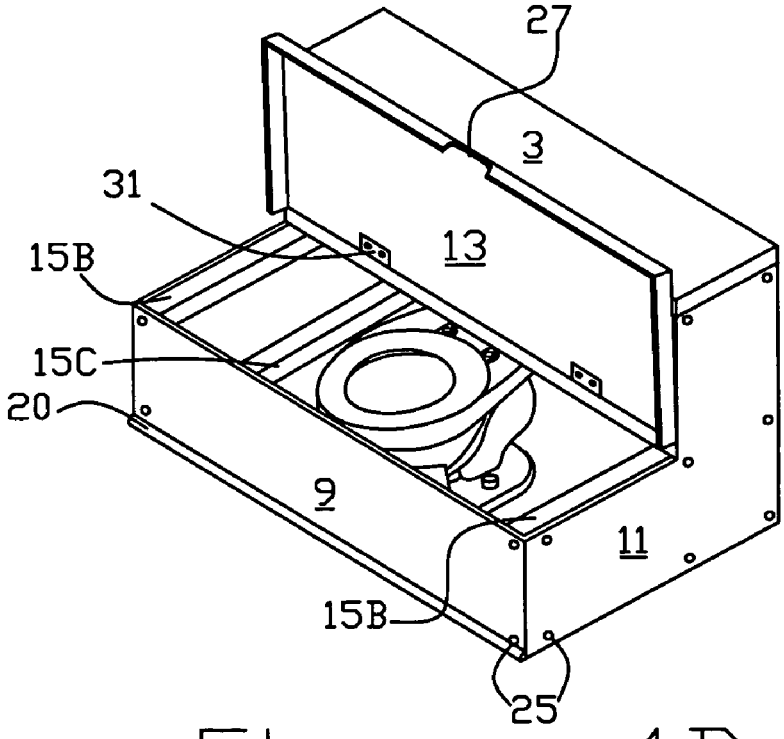
Figure 4E:
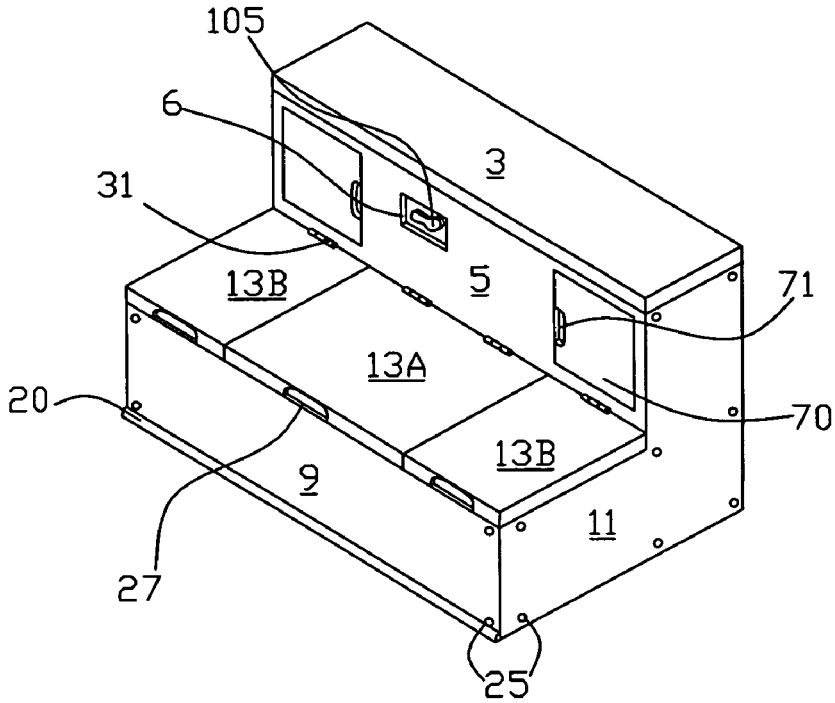
Figure 4F:
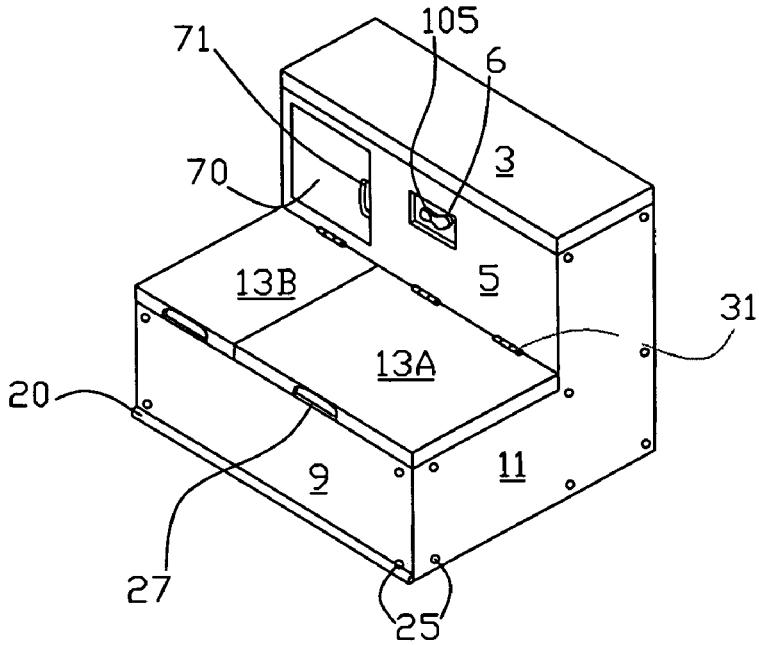
In FIG. 4F, an additional embodiment comprises a split lid 13.

FIG. 4D includes an embodiment that does not include the horizontal member 7. In this embodiment, access is provided to the interior of the cover by lifting the lid 13. In FIG. 4E, the upper face 5 includes a pair of doors 70. The lid 13 is split into three separate sections 13A through 13C to allow access to storage areas beneath sections 13B and 13C. Access is provided to the toilet bowl via lid 13A. In FIG. 4F, a single door 70 is provided in face 5. Lid 13 comprises two sections for providing access to the toilet bowl and the water supply valve.

Figure 5A:
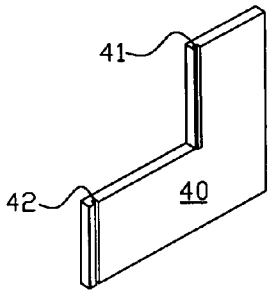
FIGS. 5A through 5D show an additional embodiment of the invention. In this embodiment, the sides include an upper grooved region and a lower grooved region into which opposite ends of each respective face are slid.
Figure 5B:
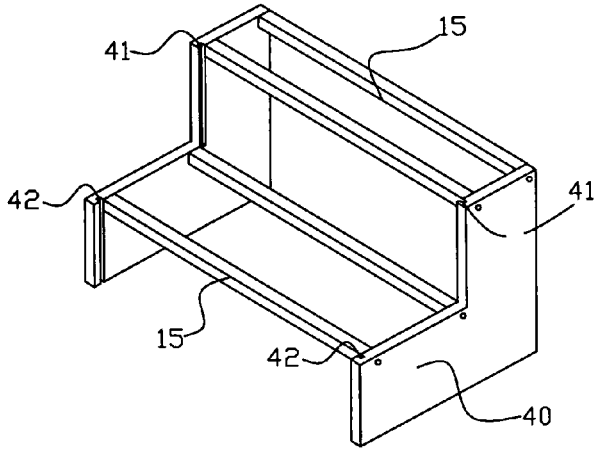
Figure 5C:
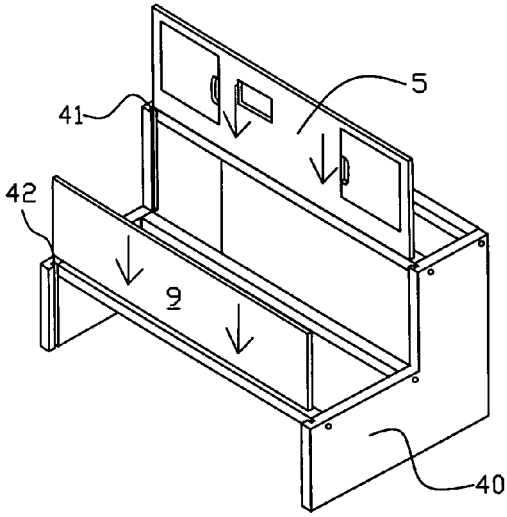
Figure 5D:
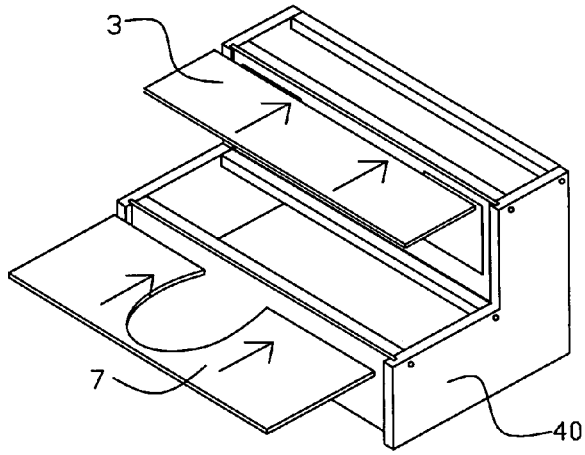

An additional embodiment of the invention includes a pair of stepped sides 40 that comprise an upper groove 41 and a lower groove 42, as shown in FIGS. 5A through 5D. As can more clearly be seen in FIG. 5B, sides 40, as shown in FIG. 5A, are fastened together via fasteners and support members 15 as in the previous embodiments. Upper and lower face panels 5 and 9 are inserted in the grooves 41 and 42, respectively and as indicated by downwardly pointing arrows, as shown in FIG. 5C. Upper lid 3 and horizontal member 7 are then deposited atop the support members 15, stepped sides 40 and face panels 5 and 9, as indicated by the arrows shown in FIG. 5D.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. A toilet cover that encloses a toilet affixed to a floor of a bathroom in front of a wall, said toilet covering comprising:

a pair of stepped sidewalls having a top, a bottom, a front side and a back side, said bottom resting on the floor to which the toilet is affixed;

an upper cover comprising a front, a back, a top face and a bottom face;

a pair of upper support members for supporting said upper cover, each upper support member having two ends, one of said pair of upper support members being in contact with the bottom face of the upper cover and providing support near the front of the upper cover, one of said pair of upper support member being in contact with the bottom face of the upper cover and providing support near the back of the upper cover, said pair of upper support members being attached at each end to one of said pair of sidewalls near the top of each sidewall such that said upper support members are substantially the same distance from the floor;

a horizontal planar sheet having a front side, a back side, a top side and a bottom side and a keyhole opening formed therein for accessing a toilet bowl;

a pair of lower support members for supporting a lower cover, each lower support member having two ends, one of said pair of lower support members being in contact with the bottom side of the horizontal planar sheet and providing support therefore, said pair of lower support members being attached at each end to one of said pair of sidewalls and arranged at a distance from the floor such that the lower support members are substantially the same distance from the floor;

an upper face comprising a sheet of rigid material, said upper face having an upper and a lower edge and two sides, the lower edge of said upper face resting upon one of said lower support members that is located away from the wall; and, a lower face comprising a sheet of rigid material, said lower face having an upper edge and a lower edge and two sides, said lower edge of the lower face resting on the floor.

2. The toilet cover of claim 1 wherein the sidewalls each comprise an upper groove and a lower groove, said two sides of the upper face being slid into the upper grooves of each sidewall, and the sides of the lower face being slid into the lower groove of each sidewall.

3. The toilet cover of claim 1 further comprising:

a first pair of hinges;

a second pair of hinges;

wherein one of the upper support members attaches to a wall behind said toilet and having said first pair of hinges attached thereto such that said upper cover rotates relative to the first support member; and, said toilet cover further characterized by a third pair of support members arranged on opposite sides of the toilet and being secured to the floor.

4. The toilet cover of claim 1 wherein said upper face comprises at least one door having hinges and for providing access to a storage area arranged behind the upper face.

5. The toilet cover of claim 1 wherein said lower face comprises at least one door having hinges and for providing access to a storage area arranged behind the lower face.

6. The toilet cover of claim 1 further comprising stepped sides attached to at least one pair of support members via fasteners selected from a group consisting of screws and nut and bolt assemblies.

7. The toilet cover of claim 1 wherein the upper face further comprises an opening through which a flush handle that operates said toilet extends.

8. The toilet cover of claim 1 further including molding attached to at least one either the upper or lower face.

9. The toilet cover of claim 1 further comprising caulking arranged between the stepped sides walls and the floor and between the lower face and the floor.

10. A combination toilet and toilet cover comprising:

a toilet tank connected to a toilet bowl and firmly affixed to a floor;

a first pair of hinges;

a second pair of hinges;

an upper cover comprising a front, a back, a handle at the front thereof and the first pair of hinges attached to the back thereof;

a first support member attached to a wall behind said toilet and having said first pair of hinges attached thereto such that said upper cover rotates relative to the first support member;

a first pair of support members arranged on opposite sides of the toilet substantially parallel to one another, being substantially equidistance from the floor and at opposite ends of the first support member;

a second pair of support members arranged on opposite sides of the toilet substantially parallel to one another, being substantially equidistance from the floor and nearer the floor than the first pair of support members;

a third pair of support members arranged on opposite sides of the toilet and being secured to the floor;

an upper face comprising a sheet of rigid material, said upper face having an upper and a lower edge and two sides, said upper face being attached tat an upper edge to the first pair of support members via fasteners and being attached at the lower edge to the second pair of support members via fasteners;

a lower face comprising a sheet of rigid material, said lower face having an upper and a lower edge and two sides, said lower face being attached at an upper edge to the second pair of support members via fasteners and being attached at the lower edge to the third pair of support members via fasteners; and, a lower cover comprising a front, a back, a handle at the front thereof and being attached to the upper face via the second pair of hinges.

11. The toilet cover of claim 10 further comprising a horizontal planar sheet having a front, a back and a keyhole opening for accessing a toilet bowl, said horizontal planar sheet being attached to both said upper face and said lower face and wherein said lower cover is disposed above said horizontal planar sheet.

12. The toilet cover of claim 10 further comprising a second lower cover that comprises a handle and is attached to the upper face via a third pair of hinges.

13. The toilet cover of claim 10 wherein said upper face comprises at least one door having hinges and for providing access to a storage area arranged behind the upper face.

14. The toilet cover of claim 10 wherein said lower face comprises at least one door having hinges and for providing access to a storage area arranged behind the lower face.

15. The toilet cover of claim 10 further comprising stepped sides attached to at least one pair of support members.

16. The toilet cover of claim 10 wherein the upper face further comprises an opening through which a flush handle that operates said toilet extends.

17. The toilet cover of claim 10 further including molding attached to at least one either the upper or lower face.

18. The toilet cover of claim 10 further comprising caulking.

19. A toilet cover that encloses a toilet affixed to a floor of a bathroom, said toilet covering comprising:

a first pair of hinges;

a second pair of hinges;

an upper cover comprising a front, a back, a handle at the front thereof and the first pair of hinges attached to the back thereof;

a first support member attached to a wall behind said toilet and having said first pair of hinges attached thereto such that said upper cover rotates relative to the first support member;

a first pair of support members arranged on opposite sides of the toilet substantially parallel to one another, being substantially equidistance from the floor and at opposite ends of the first support member;

a second pair of support members arranged on opposite sides of the toilet substantially parallel to one another, being substantially equidistance from the floor and nearer the floor than the first pair of support members;

a third pair of support members arranged on opposite sides of the toilet and being secured to the floor;

an upper face comprising a sheet of rigid material, said upper face having an upper and a lower edge and two sides, said upper face being attached tat an upper edge to the first pair of support members via fasteners and being attached at the lower edge to the second pair of support members via fasteners, the upper face further comprises an opening through which a flush handle that operates said toilet extends;

a lower face comprising a sheet of rigid material, said lower face having an upper and a lower edge and two sides, said lower face being attached at an upper edge to the second pair of support members via fasteners and being attached at the lower edge to the third pair of support members via fasteners, wherein said lower face comprises at least one door having hinges and for providing access to a storage area arranged behind the lower face;

a lower cover comprising a front, a back, a handle at the front thereof and being attached to the upper face via the second pair of hinges;

a horizontal planar sheet having a front, a back and a keyhole opening for accessing a toilet bowl, said horizontal planar sheet being attached to both said upper face and said lower face and wherein said lower cover is disposed above said horizontal planar sheet;

stepped sides attached to at least one pair of support members;

a strip of molding attached to at least one either the upper or lower face and, caulking attached to the lower face and the floor to which the toilet is attached.

* * * * *